US006111552A

United States Patent [19]

Gasser

[11] Patent Number: 6,111,552

[45] **Date of Patent: *Aug. 29, 2000**

[54] PLANAR-LIKE ANTENNA AND ASSEMBLY FOR A MOBILE COMMUNICATIONS SYSTEM

[76] Inventor: Elaine Gasser, 44 Rumer Hill Road, Cannock, Staffordshire WS11 3EX, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/913,178

[22] PCT Filed: Feb. 28, 1996

[86] PCT No.: PCT/GB96/00439

§ 371 Date: Sep. 3, 1997

§ 102(e) Date: Sep. 3, 1997

[87] PCT Pub. No.: WO96/27218

PCT Pub. Date: Sep. 6, 1996

[30] Foreign Application Priority Data

Mar. 1, 1995 [GB] United Kingdom ..... 9504096

[51] Int. Cl.[7] ..... H01Q 1/40; H01Q 1/32

[52] U.S. Cl. ..... 343/873; 343/795; 343/700 MS; 343/713

[58] Field of Search ..... 343/873, 700 MS, 343/713, 846, 848, 850, 852, 853, 858, 795; H01Q 1/38, 1/32, 1/40

[56] References Cited

U.S. PATENT DOCUMENTS

| | | | |
|---|---|---|---|
| 4,746,925 | 5/1988 | Toriyama | 343/713 |
| 4,860,019 | 8/1989 | Jiang | 343/795 |
| 4,994,820 | 2/1991 | Suzuki | 343/700 MS |
| 5,061,944 | 10/1991 | Powers et al. | 343/795 |
| 5,568,157 | 10/1996 | Anderson | 343/713 |
| 5,598,168 | 1/1997 | Evans et al. | 343/700 MS |

FOREIGN PATENT DOCUMENTS

| | | |
|---|---|---|
| 0613205A1 | 8/1994 | European Pat. Off. . |
| WO96/02074 | 1/1996 | WIPO . |

*Primary Examiner*—Hoanganh Le
*Attorney, Agent, or Firm*—Mark A. Oathout

[57] ABSTRACT

The invention relates to an antenna, and in particular to an antenna for receiving and/or transmitting electromagnetic radiation at radio frequencies, and to an antenna assembly. The antenna is suitable for frequencies in the range of around 450 MHz to around 1800 MHz, typically as used in mobile communications systems. There is provided an antenna (2; 102) for a mobile communications system which includes a symmetrical substantially planar element (4; 104) comprising two substantially planar portions (6, 8; 106, 108), the portions each being electrically conductive, characterized in that the portions have a thickness of no more than 0.1 cm and in that the element to a non-conducting base (12; 112). There is also provided an antenna assembly comprising at least two antennas connected by a phasing harness.

14 Claims, 2 Drawing Sheets

PLANAR-LIKE ANTENNA AND ASSEMBLY FOR A MOBILE COMMUNICATIONS SYSTEM

FIELD OF THE INVENTION

This invention relates to an antenna, and in particular to an antenna for receiving and/or transmitting electromagnetic radiation at radio frequencies, and to an antenna assembly.

1. Background of the Invention

Antennas, often referred to as aerials, are widely used for the reception and/or transmission of electromagnetic radiation, such as the reception of radio and television signals, and more recently the reception and transmission of mobile telephone communications.

2. Description of the Prior Art

The form of the antenna may be determined by the direction from which the signal is received (as well as the wavelength). Thus, antennas for television signal reception at a fixed building, where the direction from which the signal is received is known and is also fixed, are commonly directional, being of a complex (e.g. "yagi") shape. However, antennas for mobile radio reception (e.g. for motor vehicles, where the absolute and relative direction from which the signal is received may change and/or is unknown), must be of a non-directional type, and are commonly in the form of a long wire (or "whip"), which is substantially equally responsive to a signal received from any "generally horizontal" direction.

Alternative forms of antennas are also known, such as the self-supporting symmetrical arms disclosed in WO-88/09065, U.S. Pat. No. 2,656,463, U.S. Pat. No. 3,369,245 and others. The antennas disclosed therein all have enlarged plate-like reception/transmission elements, of significant thickness, and having a greater effective area (sometimes referred to as "capture" area) than whip antennas; they can be expected efficiently to receive signals of lower strength than corresponding whip antennas. The form of the elements can determine whether these alternative antennas are partly or substantially non-directional.

Despite the availability of above alternative antennas, known mobile telephone communication systems, both for hand-held mobile telephones, and also for mobile telephones located in motor vehicles, use whip antennas. This is, we believe, because of the relative cheapness of whip antennas to manufacture, and their well-known performance characteristics. It is known, for instance, for a vehicle with both a fitted radio and a mobile telephone unit to have a whip antenna for radio reception, and a separate whip antenna for the mobile telephone.

Whip antennas operate most efficiently if their effective length is an exact multiple of one quarter of the wavelength of the signal to be received (or the central wavelength if a range of frequencies is to be received). With most vehicle radio antennas, the received signal can range from around 200 KHz (long wave) to 100 MHz (F.M.). One quarter of the wavelength at these frequencies corresponds to approximately 375 m and 0.75 m respectively, so that a disadvantage of using whip antennas in vehicles is that most vehicle antennas in practice are shorter than even the lesser of these lengths, and so are unable to operate at maximum efficiency. However, the received signal strength, and the means developed over several years for the amplification of the signal by the radio unit, are such that adequate radio performance can usually be achieved.

The mobile telephone systems of which we are aware operate at higher frequencies than those for radio transmissions; in the U.K. for example the permitted range of the ETACS and GSM systems are 875–960 MHz. At these frequencies, one quarter of the wavelength is approximately 8.3 cm, and so most whip antennas can have an effective length equal to, or equal to a multiple of, this one quarter wavelength dimension, thus permitting the use of whip antennas for mobile telephone reception and transmission for these systems.

One disadvantage of the use of whip antennas for mobile telephone reception and transmission is that, both because of the efficiency of the whip antennas at the chosen frequency, and the relatively low signal strength of mobile telephone transmissions, the effective length of the whip antenna is critical. Thus, the band width (i.e. the frequency range over which a given antenna is able to efficiently receive a signal) is small, e.g. 10 MHz for a known whip antenna. Thus, if it is desired to "tune" the mobile telephone unit to a different operating frequency within the permitted range, the antenna length will need to be altered i.e. if the different operating frequency is outside the band width of the antenna.

A second disadvantage of the use of conventional whip antennas for mobile telephone reception and transmission is that they are readily observed. Thus, a thief is easily able to identify a vehicle having a mobile telephone, and thus target that mobile telephone for theft. This ease of observation and identification is believed to have contributed to the large increase in the numbers of mobile telephones stolen from motor vehicles.

A third disadvantage of the use of conventional whip antennas is their vulnerability to damage by vandals; thus, a vandal intent on damaging or breaking the antenna does not need to gain access to the vehicle. If the antenna is damaged or broken the operation of the mobile telephone unit will be impaired or prevented until a repaired or new antenna is installed.

In response to the second and third disadvantages outlined above, many vehicle manufacturers are understood to have investigated alternative types of antenna and/or the possible siting of the antenna(s) in a less visible or less obtrusive location in or upon the vehicle. In one attempt to overcome these disadvantages, it has been proposed to bend a whip antenna into a partial coil, and then locate this partial coil inside the vehicle. To avoid shielding from the metal surfaces of the vehicle, the coiled antenna will normally be adhered to the inside of a vehicle window; usually the vehicle rear window is the one selected since the transceiver for the mobile telephone unit will typically be located in the vehicle boot. However, the reception of such modified whip antennas (which is affected by the part-coiling of the whip, by the metal surfaces of the vehicle, and by the glass through which the signal must pass), has been found to be inadequate, and this "coiled whip" antenna concept has for this reason we believe not been greatly utilised.

A fourth disadvantage with whip antennas for mobile telephone reception and transmission, which we understand has been identified by some motor vehicle manufacturers, is that window mounted antennas are believed to result in interference with the electronics operating other vehicle components, particularly the air-bag, perhaps by a re-radiated signal of a certain wavelength. The manufacturers who have identified this fourth disadvantage have indicated their desire to site the whip antenna for a mobile telephone elsewhere than on a vehicle window, preferably in an invisible or unobtrusive location.

The DCS 1800 mobile telephone system operates at 1800 MHz. Notwithstanding the above disadvantages, the reception and transmission of a whip antenna at such frequencies (with a required effective length of approximately 4.2 cm) is unreliable in practice, so that the use of whip antennas is not widely accepted for such system.

Printed circuit boards are also known, in which a planar sheet of non-conductive material (usually ceramic, glass, or laminated or solid plastic) carries a thin layer of conductive material (typically copper). The copper is applied substantially to the whole of one face of the sheet, e.g. by roller coating, to provide a mechanical connection between the copper and the sheet. Thereafter, some of the copper is masked, and the remainder is removed by a chemical etching process, usually being dissolved in an acid or ferric chloride etchant bath, leaving the masked copper, in the areas required, intact.

Double-sided printed circuit board is also known, in which the conductive layer is applied substantially to the whole of both opposed faces of a sheet of "Fibre Glass" laminate.

Various methods of masking the copper are known, one of these being photoetching, in which a photosensitive film is applied to the copper, which film is then selectively hardened by ultraviolet light, the hardened areas protecting the required areas of copper during the subsequent etching process. Stencil etching, plating, and printing, are other known methods to produce areas of conductive material upon the sheet.

STATEMENT OF THE INVENTION

We aim to provide an antenna and/or an antenna assembly which overcomes or reduces the disadvantages associated with the known whip antennas described above, and which can be made to operate effectively at the frequencies of all of the mobile telephone systems (both digital and analogue) of which we are aware. Our antenna and assembly have a relatively large capture area and have been designed for use inside or outside a vehicle, and/or in an invisible or unobtrusive location upon the motor vehicle.

Thus, we provide an antenna for a motor vehicle which includes a symmetrical substantially planar element comprising two substantially planar portions, the portions each being electrically conductive, characterised in that the portions have a thickness of no more than 0.1 cm and in that the element is secured to a non-conducting base. Preferably the element is copper, roller coated onto a planar non-conducting insulating sheet.

Preferably, the portions have a thickness in the range 10 $\mu$m –100 $\mu$m (0.001 cm–0.01 cm); desirably the portions have thickness of 35 $\mu$m (0.0035 cm).

We also provide an antenna for a motor vehicle, the antenna having an electrically conductive plate-like receiving/transmitting element, characterised in that the element is manufactured from printed circuit board material. Desirably the element is of copper, mounted to a glass laminate material.

Such an antenna has the advantages that (i) it is straightforward and cost-effective to manufacture, utilising established materials and methods, {ii} copper can readily be connected, as by soldering, to an electrically conductive cable, and {iii} the mechanically adhered copper is less likely to become free of the base board than for example a chemically adhered conductive layer, following repeated environmental heating and cooling of the element and board. In this latter regard, should part of the element become free of the base and result in a local discontinuity in the element, it is known that the reception/transmission performance of the antenna would be adversely affected.

We also provide a method of manufacturing an antenna including the steps of {i} selecting a printed circuit board comprising a copper layer on a non-conductive base, {ii} masking part of the copper layer to conceal the shape of the receiving/transmitting element to be produced; and {iii} chemically etching away the copper from the unmasked areas.

Preferably the printed circuit board is double-sided, the receiving and transmitting element being formed on one side (the first side) of the base and at least one reflecting panel being formed on the other side (the second side) of the base. The reflecting panel(s) is/are usefully adapted to reflect some of the incident signal directed towards the receiving/transmitting element, to improve the signal directional stability and to reduce false (ghost) signals. Preferably, at least part of the or each reflecting panel covers a section of the said second side, the first side of which section is free of conducting material.

We further provide an antenna having a housing, an electrically conductive plate-like receiving/transmitting element located within the housing, the element comprising two portions, each portion being connected to an electrically conductive wire, the wires projecting from the housing, the said element being of copper, and the housing having a substantially planar surface for adhering to the inside face of a window of a motor vehicle. Desirably one of the wires is, or is connected to, the central core of a coaxial cable, and the other of the wires is connected to the sheathing of the cable, the cable thus having separate connections to the two portions of the element. Preferably, the said surface is non-rigid, and so is able to conform to a non-planar window. We foresee that in a less preferred embodiment the housing can directly or indirectly clamp (or help clamp) the (copper) element, and the (copper) reflecting panels, to the base.

We have found that the glass of the vehicle window to which the housing may be adhered cooperates with our form of receiving/transmitting element, having a capacitative effect which we believe serves to amplify the signal received by the element. We have also found that our antenna does not share the fourth disadvantage of whip antennas discussed above.

Furthermore, we have found that our preferred form of receiving/transmitting element has a band width of approximately 300 MHz, and so does not require re-tuning to the various frequencies within the permitted range for the chosen mobile telephone system.

Usefully, the housing has adhering means by which it may be adhered to the window. Usefully also, the housing is formed of a thin plastics material, suitably styrene.

Desirably, the exposed surface of the element is covered with adhering means to prevent oxidation of the surface; desirably also, the housing is water-tight.

The antenna, when fitted to the inside of a vehicle, for instance to a top corner of a rear window of the vehicle, can be covered by a sticker, such as that denoting the country of origin of the vehicle, which sticker is adhered to the outer surface of the window thus obscuring the antenna from view; alternatively, the housing surface for adhering to the inside face of the window can carry printed information, again with the dual purpose of disguising the housing.

In another embodiment of the invention, we provide an antenna assembly having first and second electrically conductive plate-like receiving/transmitting elements, the elements being connected to a phasing harness.

Preferably, the first element is connected to a junction means by a first cable and the second element is connected to the junction means by a second cable, the first cable having a first impedance and a first length, the second cable having a first impedance and a second length, the junction means being connectable to a receiving unit by a third cable, the third cable having a first impedance and a third length, the junction means having fourth and fifth cables, one end of each of the fourth and fifth cables being connected to the third cable, the other end of the fourth cable being connected to the first cable and the other end of the fifth cable being connected to the second cable, the said fourth cable having a second impedance and a fourth length, the said fifth cable having a second impedance and a fifth length.

Usefully, the said fourth length and fifth length are identical, and are one quarter of the wavelength of the signal to be received/transmitted; usefully also, each of the said first, second and third lengths are a multiple of one quarter of the wavelength.

If the said receiving unit is a mobile telephone, the first impedance will be 50 ohms, and the second impedance will be 75 ohms.

We have found that such an arrangement with two receiving/transmitting elements, each with a relatively large capture area, and being connected to a phasing harness and working in parallel, enables the antenna assembly to be fitted for example within the rear (plastics) bumper of a motor vehicle, with one receiving/transmitting element at each end of the bumper. Such a location will we believe overcome the fourth disadvantage identified above.

If to be fitted into the rear bumper of a motor vehicle, the receiving/transmitting elements can be located during manufacture of the bumper; however, if fitted to an existing bumper it is preferred that each element, and the junction means, be located in respective housings. In this latter case, the housings may have a perspex or other dielectric plate secured thereto to provide a capacitative and amplifying effect for the signal.

BRIEF DESCRIPTION OF THE DRAWINGS

The invention will be further described, by way of example, with reference to the accompanying drawings, in which.

DETAILED DESCRIPTION OF THE PREFERRED EMBODIMENTS

Figure 1:
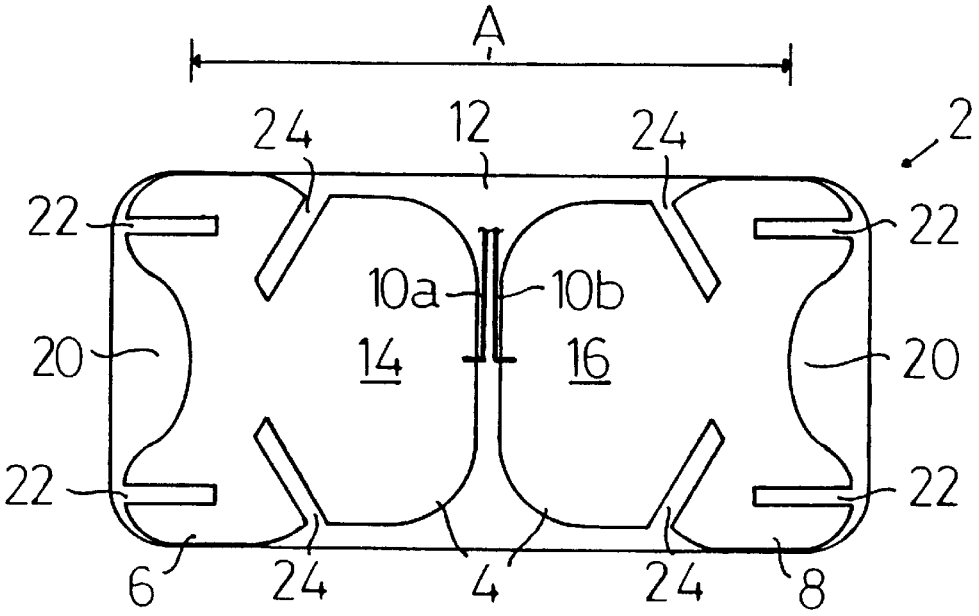
FIG. 1 is a plan view of a receiving/transmitting element for use in an antenna according to the invention, the element being mounted upon a board.

As seen in FIG. 1, our preferred form of antenna 2 includes a receiving/transmitting element 4 comprising a pair of shaped electrically conducting portions 6,8, each independently connected (as by solder) to a respective wire 10*a*, 10*b*. The portions 6,8 are mounted on a base 12, to prevent relative movement.

The portions 6,8 are mirror-images; each is symmetrical about the centre-line of element 4 (a line left-right across the paper through the centre of the element 4, as viewed).

The portions 6,8 each have a generally rectangular form, but with a narrowed facing central part 14,16, rounded corners, and several recesses. Thus, in this embodiment each portion has a curved recess 20, and straight-edged recesses 22 and 24. The exact form and shape of the portions, and the recesses therein, determines the frequency range and band width over which the element will resonate, i.e. the frequency range and band width over which it will receive and transmit signals, as can readily be determined by those skilled in this art.

An element made substantially according to FIG. 1, and with a dimension A of 8.3 cm, has been found to operate effectively at the 875–910 MHz frequency range. Tests have shown that with a dimension A of 4.17 cm the element would operate effectively at the 1800 MHz frequency, and with a dimension A of 16.7 cm the element would operate effectively a frequency of 450 MHz (a frequency used for the UHF mobile communications system).

Figure 2:
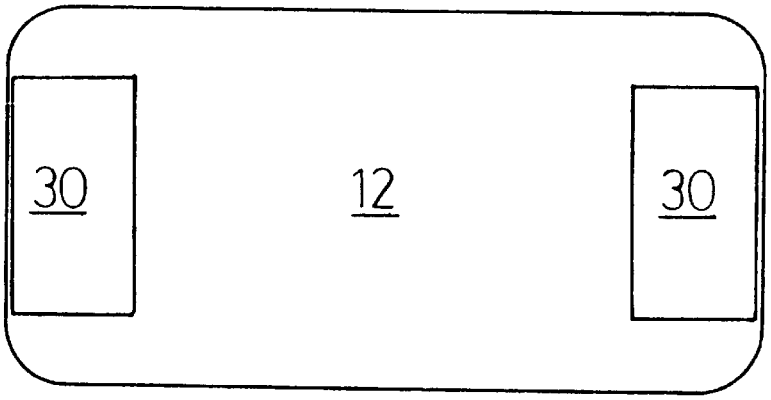
FIG. 2 is a view of the underside of the board of FIG. 1.

The portions 6,8 are of copper. In this embodiment the antenna 2 is manufactured using as a starting material a slab of 0.08 cm thick fibre glass laminate (as an insulating base), roller coated on both sides with a 0.01 cm thick layer of copper, made as would be a slab for a double-sided printed circuit board. Selected regions of the copper on one face of the base are etched away around the portions 6,8 (FIG. 1), in known fashion until the base 12 locally is exposed. To the other side of base 12 the copper is also etched away to provide a pair of reflecting panels 30 (FIG. 2) and which in this embodiment are therefore also of copper, and which after the etching process remain firmly affixed to the underside of the base 12.

In this embodiment, the wires 10*a* and 10*b* are connected to coaxial cable 32; wire 10*a* is connected to the central core of the cable, wire 10*b* is connected to the sheathing of the cable. Thus, the portions 6,8 are electrically independent of each other.

Figure 3:
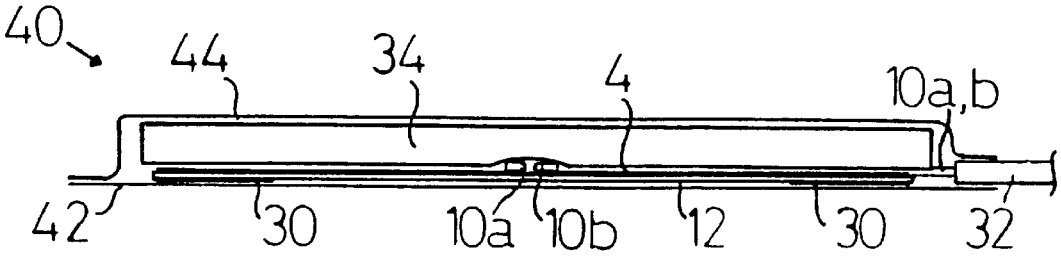
FIG. 3 is a side-sectional view of an antenna according to the invention.

As shown in FIG. 3, an antenna 2 according to the invention comprises an insulating base 12 upon which is located a receiving/transmitting element 4 and a pair of reflecting panels 30. After assembly, the exposed face of the element 4 (i.e. the exposed faces of the portions 6,8) is coated with adhesive (not shown) and a layer of foam 34 is applied; it is a feature of this embodiment of the invention that the foam acts to protect the element 4 from impacts, and acts together with the adhesive as a water/air sealant protecting the element 4 from oxidation. The above components are located in a housing 40, in this embodiment of styrene, which has a substantially planar surface 42 (by which the housing may be adhered to the inside face of a window of a motor vehicle), and a secured cover 44.

It will be understood that in the fitted condition of this embodiment of antenna, e.g. on a vehicle window, the base 12 is arranged with the element 4 facing away from the window.

Styrene is the preferred material for the housing of an antenna to be fitted to a vehicle window, since it is stable within the temperature range likely to be encountered in such a location; in addition, it is readily formable into the shape desired, and, for the thickness of sheet required to form the housing, is sufficiently non-rigid to conform to a non-planar vehicle window. However, any material which is transparent, or substantially so, to electromagnetic radiation could alternatively be used.

The cover 44 includes a portway 46 through which coaxial cable 32 may protrude from the housing 40. In an alternative embodiment the portway is mid-way along one of the longer edges of the housing, so that the cable protrudes from the housing substantially co-linearly with the wires 10*a,b* of FIG. 1.

The cable 32 connects the antenna to the receiving unit e.g. a mobile telephone.

Figure 4:
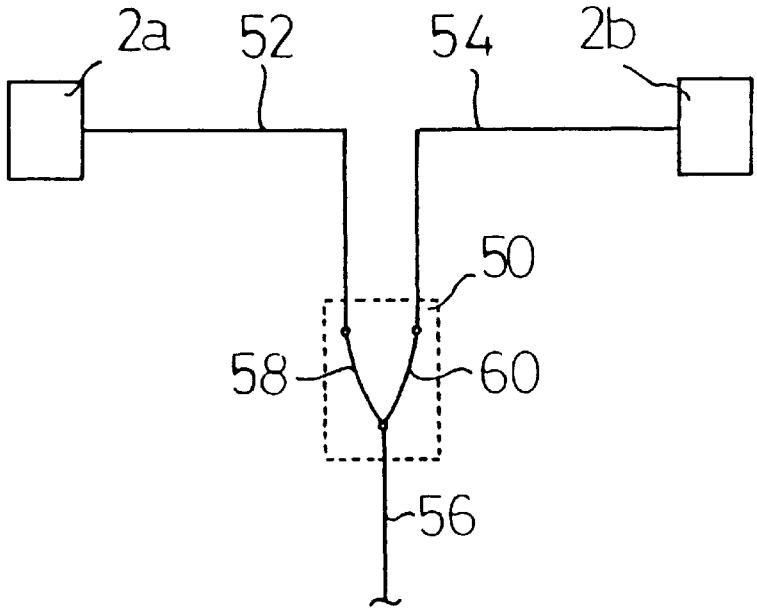
FIG. 4 is a schematic representation of an antenna assembly.

FIG. 4 shows an embodiment of antenna assembly having a pair of receiving/transmitting antennas 2*a*, 2*b* connected to a junction means 50. The antennas and junction means provide a phasing harness, in that the antennas work in phase, so increasing the strength of the signal communicated to the receiving unit, whilst appearing as a single antenna to the receiving unit.

In this embodiment, the first antenna 2*a* is connected by a first cable 52 to one end of a fourth cable 58 located inside the junction means 50; the second antenna 2*b* is connected by a second cable 54 to one end of a fifth cable 60 located inside the junction means 50. The other ends of fourth and fifth cables 58,60 are connected to third cable 56, which communicates the signal to the receiving unit (not shown). In this embodiment, all of cables 52,54,56,58 and 60 are coaxial; however, in an alternative embodiment conducting strips can be used instead of these cables.

In the embodiment shown, the antenna assembly is for a mobile telephone unit. Such units operate at a cable impedance of 50 ohms, so that the impedance of cables 52,54 and 56 is 50 ohms, and the impedance of cables 58 and 60 is 75 ohms. Also, the length of cables 58 and 60 is identical, and corresponds to ¼ of the wavelength of the signal to be received/transmitted. For a mobile telephone network operating at a frequency of around 900 MHz, ¼ of the wavelength is 8.3 cm, so that cables 58 and 60 are 8.3 cm in length. In addition, the length of each of cables 52,54 and 56 is an exact multiple of 8.3 cm.

If fitted to (or into) the rear bumper of a motor vehicle, the antenna assembly of the invention will, we believe, enable acceptable performance of a mobile telephone unit, despite the antenna elements being closer to the ground than conventional whip antennas (in which location an incoming/outgoing signal is more likely to be affected by interference from extraneous articles).

In alternative embodiments of antenna assembly, more than two antennas may be interconnected by a phasing harness to work in parallel.

We have thus proposed an arrangement for both receiving and transmitting signals of radio frequency, suited for fitment into a movable vehicle for a mobile telephone installation.

Figure 5:
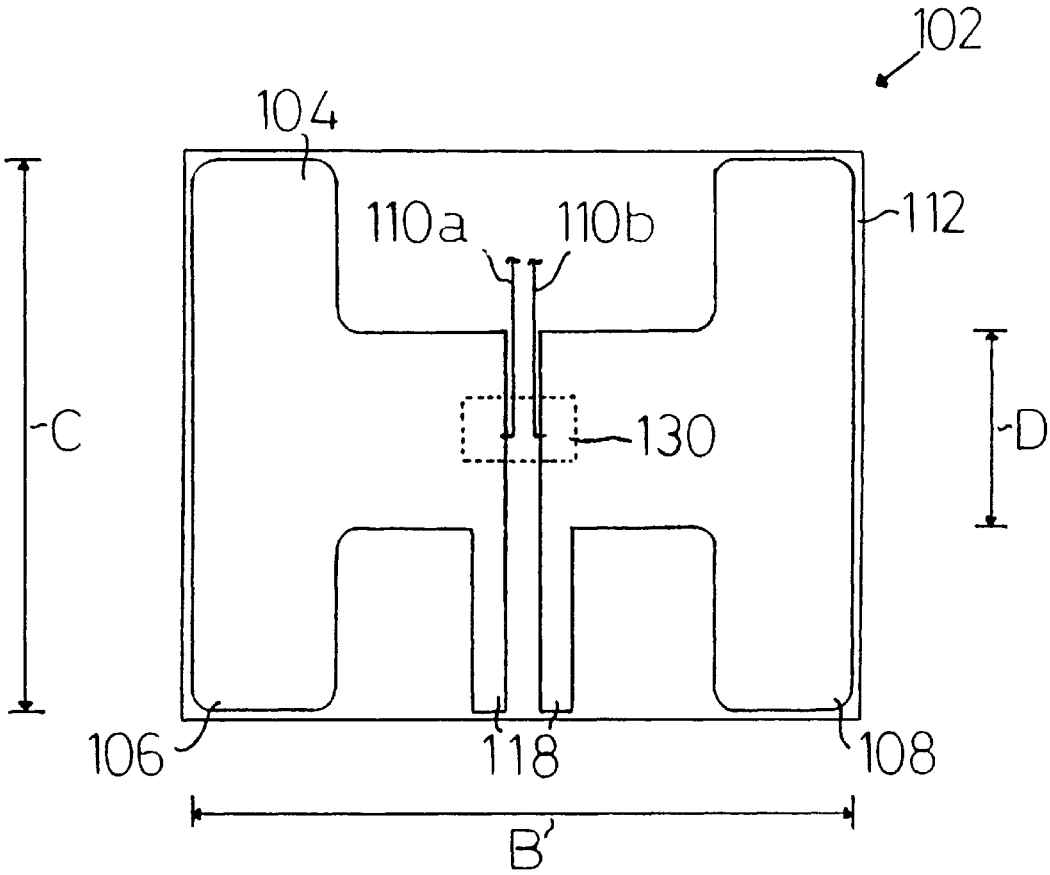
FIG. 5 is a plan view of an alternative receiving/transmitting element.

In the alternative element of FIG. 5, antenna 102 includes a receiving/transmitting element 104 comprising a pair of substantially T-shaped electrically conducting portions 106, 108, each independently connected (as by solder) to a respective wire 110*a*,110*b*. The portions 106,108 are mounted on a base 112, to prevent relative movement.

The portions 106,108 are again mirror-images; each is symmetrical about the centre-line of element 104 except for an extension 118. To the other side of base 112 is a reflecting panel 130, shown in dotted outline.

An element of double-sided copper printed circuit board, made substantially according to FIG. 5, and with dimensions B=18.7 cm; C=15.9 cm; and D=5.5 cm, has been found to operate effectively at a frequency of 450 MHz.

In addition to the shortcomings of external whip type antennas when used in mobile cellular communications systems as outlined in the Description of the Prior Art above, there are further shortcomings of an electrical nature. These include:

{a} Whip antennas have a small surface area to transmit and receive signals. This limits the usable bandwidth to typically 10 Mhz and therefore limits the overall efficiency of the antenna.

{b} Whip antennas pick up a mixture of signal and airborne noise, typically 70% signal to 30% noise, resulting in a reduced quality of transmitted and received sound, particularly as the mobile telephone unit approaches the edge of a transmission area.

{c} During transmission, antennas experience a known problem whereby reverse power travels back down the antenna and cancels out part of the forward power (VSWR). Typically, a good quality whip antenna would at best transmit 95% of signal and lose 5%, but only over a small bandwidth (10 MHz).

{d} Whip antennas receive direct waves and waves reflected from nearby buildings and from the ground. These reflected signals are known to interfere with the direct waves and reduce the effective signal received by the antenna. Accordingly, for use on a vehicle it is desirable (and indeed necessary in some cases), to mount whip antennas externally and as high on the vehicle as possible, either on the roof or adjacent the top of the rear window.

The Flat Plate Technology utilised by the present invention overcomes or reduces the shortcomings of whip antennas as outlined in the Description of the Prior Art. In addition, because the device behaves in a manner not previously achieved by conventional antennas, a series of improvements have been made, which when added together result in the enhanced performance of the antenna according to the invention. These improvements include:

{a} The effective capture area of an antenna according to the invention is very large compared to a whip antenna. This results in much more signal being received and transmitted and over a much larger bandwidth (e.g. 300 MHz).

{b} The signal to noise ratio is greatly improved, typically 93% signal to 7% noise. This significantly improves the quality of the received and transmitted sound, and allows the mobile telephone unit to increase its transmission area.

{c} During transmission an antenna according to the invention sends out more than 99% of its signal and loses less than 1% in reverse. It does this over a much larger bandwidth (300 MHz).

{d} The location criteria which govern conventional antennas do not apply to an antenna according to the invention. In addition to the qualities outlined in points {a} to {c} above, our antenna is not ground distance dependent as we believe it makes use of the surrounding reflective surfaces to improve its performance.

I claim:

1. An antenna for a mobile communications system which includes a non-conducting base, an element comprising two substantially planar portions each secured to one side of the base with the portions symmetrically disposed, the portions each being electrically conductive and having a thickness of no more than 0.1 cm, at least one substantially planar panel secured to another side of the base, the at least one panel being electrically conductive, the at least one panel being electrically disconnected from the element, the element having a means for receiving and transmitting signals substantially non-directionally, wherein the portions are electrically independent of each other.

2. An antenna according to claim 1 wherein the portions have a thickness of at least 0.001 cm.

3. An antenna according to claim 1 wherein the element is of copper, roller coated onto a planar non-conducting insulating sheet.

4. An antenna according to claim 1, wherein the element is manufactured from printed circuit board material.

5. An antenna according to claim 1 wherein at least part of the at least one panel covers a section of the other side of the base, wherein the section on the one side of the base does not have a part of the element secured thereto.

6. An antenna according to claim 5 wherein at least part of the element covers a section of the one side of the base, wherein the section on the other side of the base does not have a part of the at least one panel secured thereto.

7. An antenna according to claim 1 mounted in a housing, each portion being connected to an electrically conductive wire, the wires projecting from the housing.

8. An antenna according to claim 7 wherein one of the wires is, or is connected to, the central core of a coaxial cable, wherein the other of the wires is connected to the sheathing of the cable, and wherein the housing has a substantially planar surface adapted for adhering the housing to the inside face of a motor vehicle window.

9. A method of manufacturing an antenna according to claim 1 including the steps of {i} selecting a printed circuit board comprising a copper layer on a non-conductive base, {ii} masking part of the copper layer to conceal the shape of the receiving/transmitting element to be produced; and {iii} chemically etching away the copper from the unmasked areas.

10. An assembly comprising an antenna as claimed in claim 1, wherein the antenna is housed in a material which is substantially transparent to electromagnetic radiation.

11. An assembly according to claim 10 characterised in that the antenna has to one side a vehicle window part and to the other side an antenna cover.

12. An antenna according to claim 1 wherein at least part of the element covers a section of the one side of the base, wherein the section on the other side of the base does not have a part of the at least one panel secured hereto.

13. An antenna assembly having a first and a second antenna according to claim 1, each of the first and the second antennas including: a non-conducting base, an element comprising two substantially planar portions each secured to one side of the base with the portions symmetrically disposed, the portions each being electrically conductive and having a thickness of no more than 0.1 cm, at lease one substantially planar panel secured to the other side of the base, the at least one panel being electrically conductive, the at least one panel being electrically disconnected from the element, the element being both a signal receiver and a signal transmitter whereby the antenna is suited for a mobile communication system;

wherein the first antenna is connected to a junction means by a first cable and the second antenna is connected to the junction means by a second cable, the first cable having a first impedance and a first length, the second cable having a first impedance and a second length, the junction means being connectable to a receiving unit by a third cable, the third cable having a first impedance and third length, the junction means having a fourth cable and a fifth cable, one end of each of the fourth and fifth cables being connected to the third cable, the other end of the fourth cable being connected to the first cable and the other end of the fifth cable being connected to the second cable, said fourth cable having a second impedance and a fourth length, said fifth cable having a second impedance and a fifth length.

14. An antenna assembly according to claim 13 wherein the said fourth length and fifth length are identical, and are one quarter of the wavelength of the signal to be received/transmitted, and wherein the first impedance is 50 ohms, and the second impedance is 75 ohms.

* * * * *